US007753317B1

(12) United States Patent
Schirmer

(10) Patent No.: US 7,753,317 B1
(45) Date of Patent: Jul. 13, 2010

(54) LOW PROFILE PORTABLE DERAIL

(75) Inventor: Michael L. Schirmer, House Springs, MO (US)

(73) Assignee: Aldon Company, Inc., Waukegan, IL (US)

( * ) Notice: Subject to any disclaimer, the term of this patent is extended or adjusted under 35 U.S.C. 154(b) by 0 days.

(21) Appl. No.: 12/378,766

(22) Filed: Feb. 20, 2009

(51) Int. Cl.
*B61L 19/02* (2006.01)

(52) U.S. Cl. ..... 246/163; 104/261

(58) Field of Classification Search ..... 104/261; 246/163

See application file for complete search history.

(56) References Cited

U.S. PATENT DOCUMENTS 1,464,606 A * 8/1923 Hayes ..... 246/163
1,464,607 A * 8/1923 Hayes ..... 246/163
1,627,092 A * 5/1927 Hayes ..... 246/163
2,829,246 A * 4/1958 Hayes ..... 246/163
4,165,060 A * 8/1979 Meyer ..... 246/163
6,105,906 A * 8/2000 Pease et al. ..... 246/163
6,178,893 B1 * 1/2001 Pease ..... 104/261
6,202,564 B1 * 3/2001 Hart et al. ..... 104/261
7,549,611 B2 * 6/2009 Hertel ..... 246/163
2008/0023592 A1 * 1/2008 Hertel ..... 246/163

* cited by examiner

*Primary Examiner*—S. Joseph Morano
*Assistant Examiner*—Jason C Smith
(74) *Attorney, Agent, or Firm*—Anthony S. Zummer

(57) ABSTRACT

This invention relates to a portable low profile derail which is releasably securable to a railroad rail for derailing from the rail a flanged wheel of railroad equipment. The derail has a monolithic body including a flat rider plate and an integral elongated holding channel. At least three field side fasteners are mounted on the holding channel and connectable with the rail. A substantially straight rub bar is fixed to the derail body and is set at an angle to the rail when the derail is secured to the rail. The derail includes a securing assembly which is selectively connectable to the rail for securing the derail onto the rail.

17 Claims, 4 Drawing Sheets

LOW PROFILE PORTABLE DERAIL

FIELD OF THE INVENTION

The present invention relates to a low profile portable derail used in the railroad industry. The subject derail is a lightweight derail which may be readily installed by a single workman without the need for special tools to make the installation. The derail is capable of derailing not only a railroad car, but also a locomotive. The derail may be readily removed when there is no longer the need for the derail.

BACKGROUND OF THE INVENTION

The utilization of derails in the railroad industry is well known and accepted. Typically, derails are used to prevent railroad equipment, such as a car or a locomotive from passing a certain point. The need for protecting a certain point from passage by equipment is created under a number of circumstances. A typical circumstance is one wherein workmen are working a car which is positioned at a given track. The requirement of safety and prevention of accidental injury to workmen is paramount. A typical and accepted method of prevention of movement of a car being repaired is to position a derail on the track with the car. Typically, a blue flag is positioned on the track to serve notice that entry of railroad equipment upon the track is prohibited. However, to protect against a failure to observe the blue flag, a derail is mounted on a rail which causes a car or locomotive to be displaced from the track so that it does not engage the protected car.

Derails are well known in the railroad art. It is desirable to provide a lightweight derail which may be moved by a single workman. An example of a known derail is disclosed in U.S. Pat. No. 6,105,906, issued Aug. 22, 2000, to Pease, et al. It is particularly advantageous for a derail to not only be moved by a single workman, but it is also advantageous for the derail to be installed by a single workman without the need for special tools. Thus, the installation of the derail is simplified resulting in improvement of the efficiency of the installation.

A derail must have a low profile so that it is not engaged by a track clearing equipment on a locomotive and pushed along the rail thereby failing to accomplish its basic purpose of stopping movement of a locomotive past a given point.

It is further necessary to provide a derail which will make solid contact with a tie thereby preventing movement of the derail along a rail.

SUMMARY OF THE INVENTION

The instant derail is a low profile light weight portable derail, which may be readily installed by a single workman. It is readily securable to a railroad rail head for derailing from the rail head a flanged wheel of railroad equipment. The present derail has a monolithic derail body including a flat rider plate and a curved holding channel formed integral with an edge of the rider plate. The curved holding channel forms a continuous member with the rider plate eliminating any stress points which may cause breaking or other damage to the derail body. The curved opening of the holding channel is large enough to receive a portion of the field side of the rail head. At least three field side thumbscrews are mounted on the holding channel and are connectable with the underside of the field side of the rail head to secure the rider plate to the rail head. A substantially straight rub bar is fixed to the rider plate for engagement with a flanged wheel to be derailed from the rail head. The rub bar has a flat straight derail edge which is engagable with a wheel. A locking pad is fixed to the underside of the rider plate and is spaced away from the holding channel to allow positioning of the derail body onto the rail head. A swing arm is pivotedly mounted on the locking pad. A retainer fastener is mounted on the swing arm and is connectable with an underside of the gauge side of the rail head for holding the derail onto the rail head. A comb is connected to the derail body for engagement with a tie supporting the rail.

BRIEF DESCRIPTION OF THE DRAWINGS

The present derail is described in the following specification and shown in the accompanying drawings.

FIG. 2 is a perspective view of the opposite side of the derail shown in

FIG. 1;

DETAILED DESCRIPTION OF THE INVENTION

Figure 1:
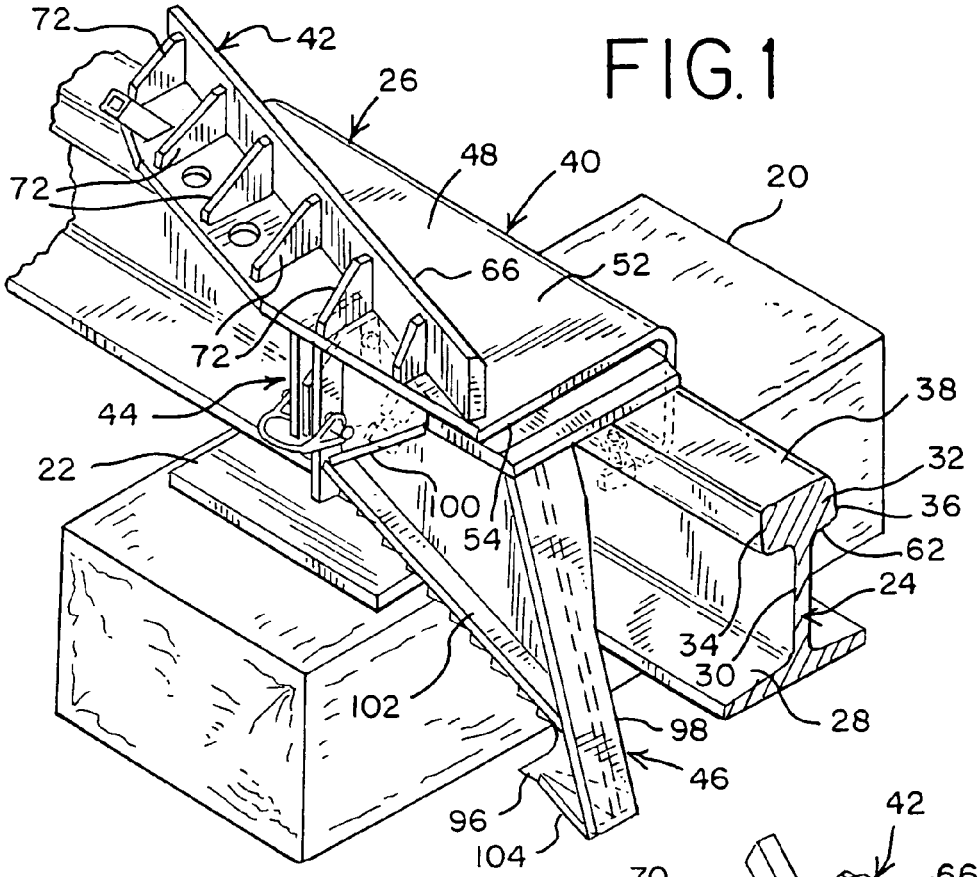
FIG. 1 is a perspective view of a derail embodying the present invention shown mounted on a conventional tee rail and having a comb of the derail positioned adjacent to a tie supporting the rail.
Figure 2:
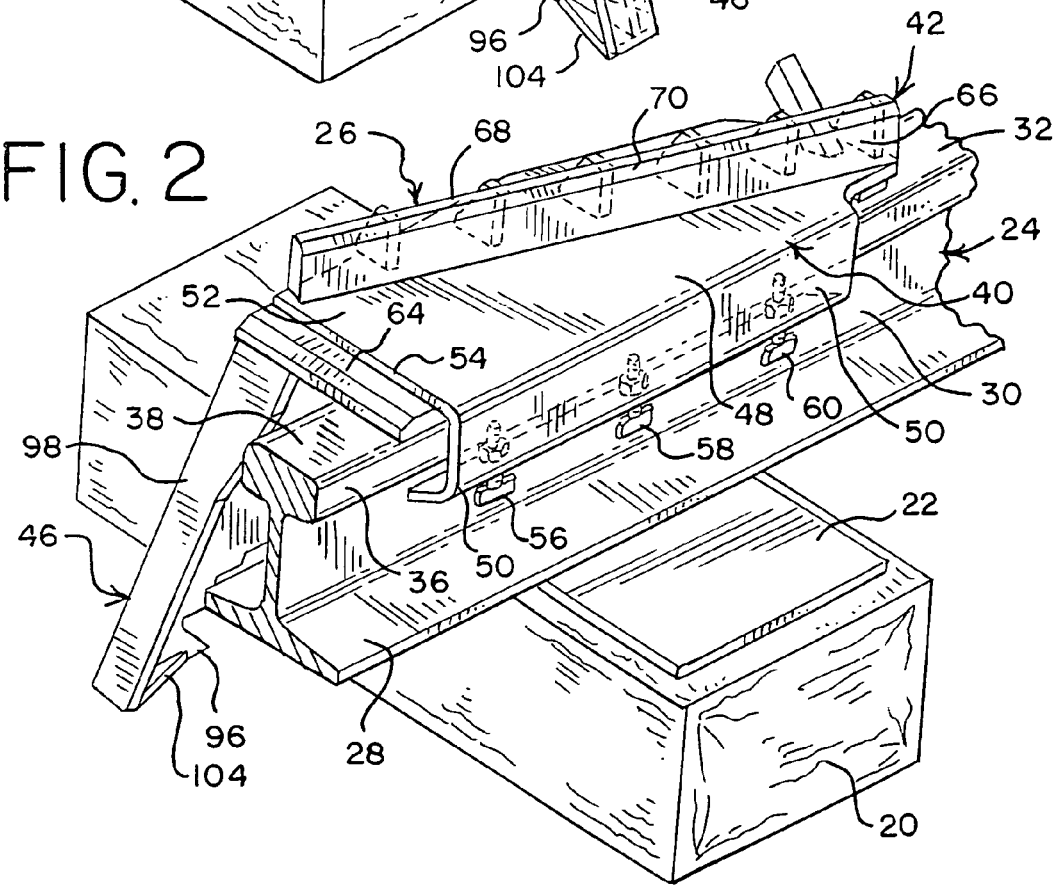

Referring now to the drawings, and especially to FIG. 1, a conventional railroad tie 20 is shown with a rail supporting apparatus including a baseplate or tie plate 22 mounted thereon. A conventional railroad tee rail 24 is mounted on the tie plate. A derail 26 is mounted on rail 24. Derail 26 is a specific embodiment of the present invention. Rail 24 is a conventional construction having a base 28 with a web 30 formed integral with the base. A rail head 32 is formed integral with the web. The rail head includes a gauge side 34 and an opposed field side 36. The gauge side 34 is the side adjacent to the other rail of a track consisting of a pair of rails. The rail head includes a head top 38.

Derail 26 includes a monolithic derail body 40 with a bar assembly 42 mounted on body 40 for engaging a wheel to displace the wheel from a rail head. A securing assembly 44 is mounted on the body to lock the derail body to the gauge side of the rail head. A comb assembly 46 is fixed to the body for engagement with the tie to prevent the derail from sliding along the rail head when the derail is engaged by a wheel of railroad equipment.

The derail body is a single integral part including a substantially flat rider plate 48 with a curved holding channel 50 formed integral with one edge of the rider plate. The monolithic construction of the derail body provides a high strength body free of any points for stress concentration. The bar assembly is mounted on an upper side 52 of the rider plate. The rider plate has an underside 54 which supports securing assembly 44. The channel has three identical thumbscrews 56, 58, and 60 threadedly mounted thereon and engagable with an underside 62 of the field side of the rail head to secure the derail body to the rail head. The use of three thumbscrews assures alignment of the channel with the rail head. A beveled step plate 64 is mounted under rider plate 48 to facilitate entry of a wheel onto the rider plate for engagement with the bar assembly.

Bar assembly 42 includes an elongated rub bar 66. The rub bar is a straight bar having a top edge 68 with a beveled edge 70 joining the top edge. Rub bar 66 is secured in an upright position by a plurality of gussets 72, which are fixed to the upper surface 52 of plate 48 and to the rub bar. The rub bart is set at an angle of 18.63° relative to the channel.

Figure 3:
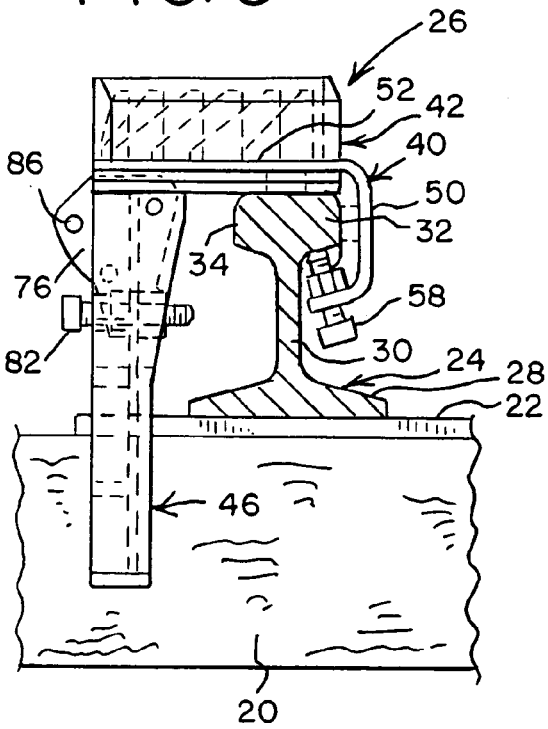
FIG. 3 is an end view of the derail shown in FIGS. 1 and 2 and showing a rail in cross section showing thumbscrews in engagement with the rail head and a swing arm in an open position.
Figure 4:
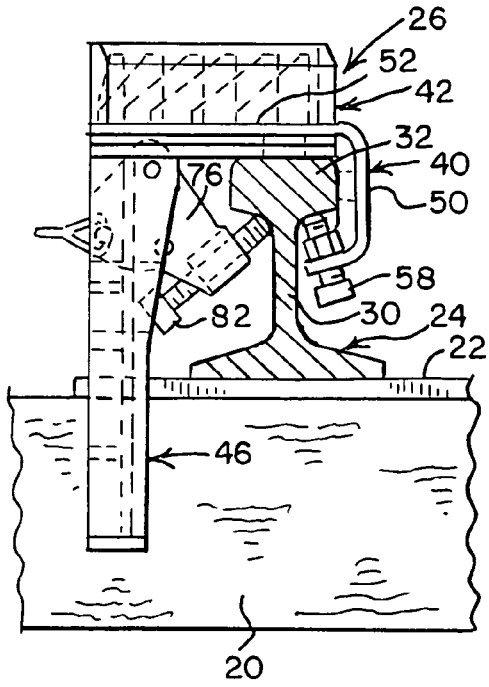
FIG. 4 is similar to FIG. 3, but showing a swing arm connected to the rail head to lock the derail onto the rail.
Figure 5:
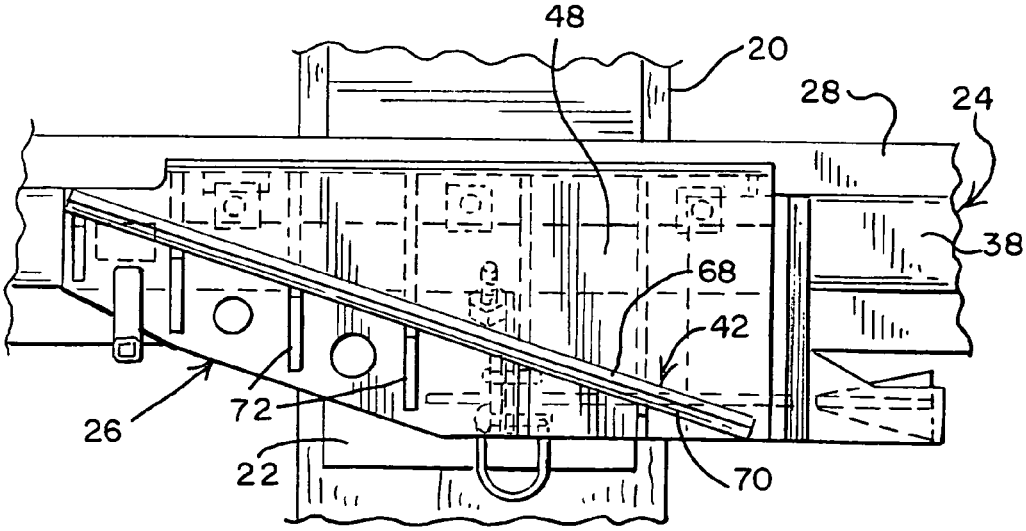
FIG. 5 is a plan view of the derail shown in FIG. 1 shown mounted on a rail head.
Figure 6:
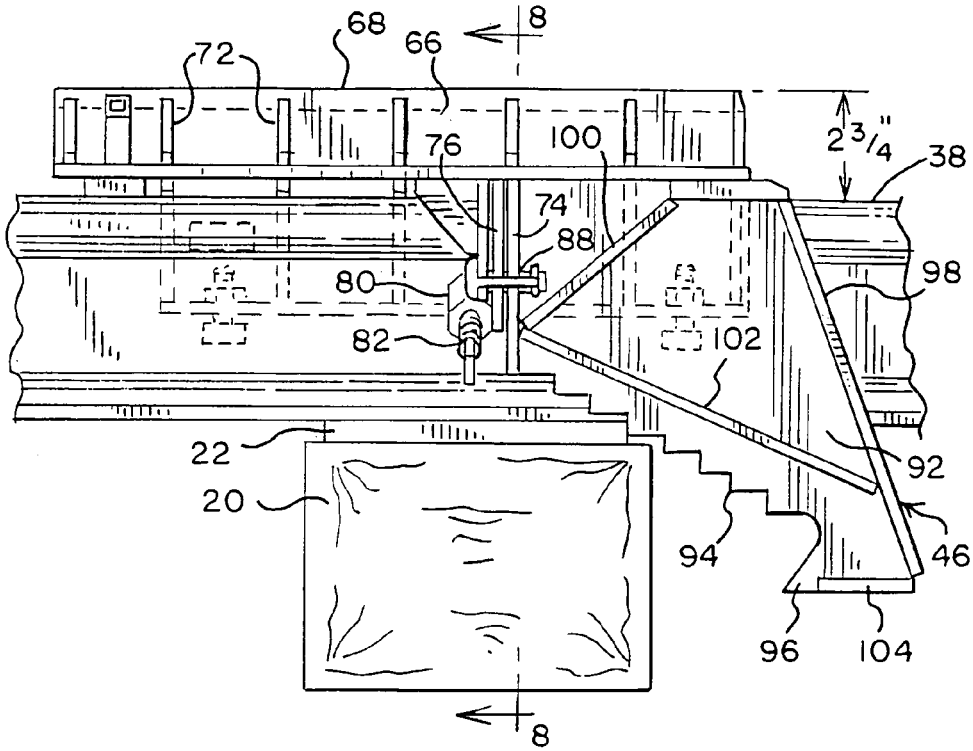
FIG. 6 is a side elevational view of the derail shown in FIG. 1.
Figure 7:
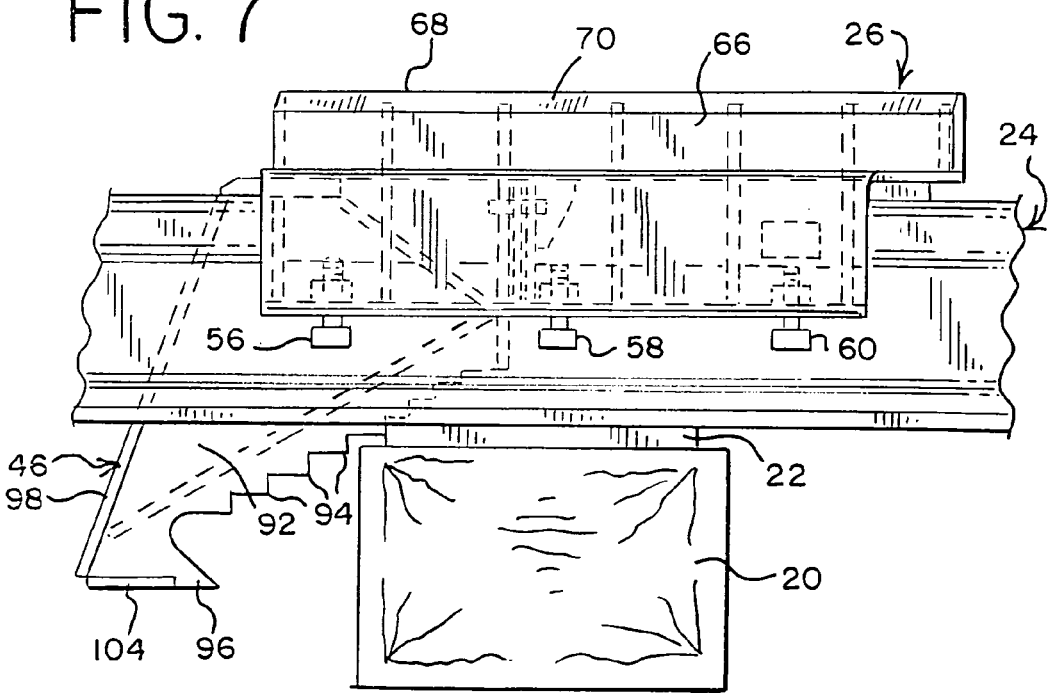
FIG. 7 is a side elevational view of the derail of FIG. 1, but of the opposite side of the derail of FIG. 6.
Figure 8:
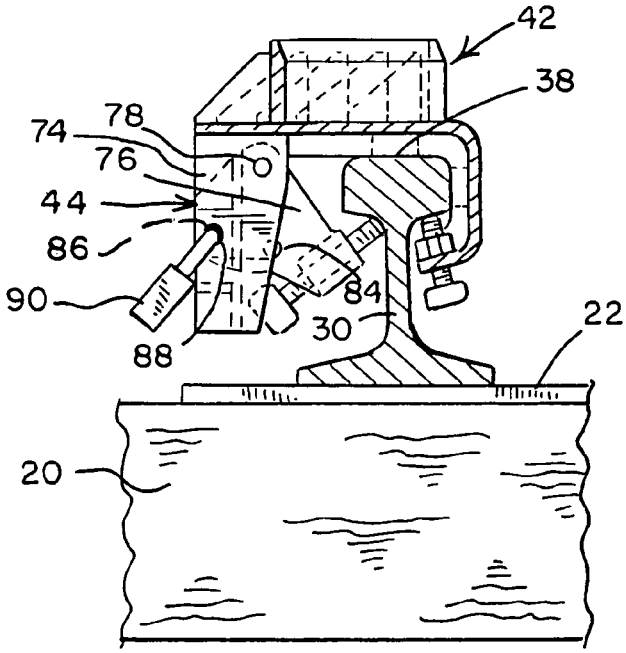
FIG. 8 is a cross sectional view taken on Line 8-8 of FIG. 6, but showing a pad lock in position to show how a lock may be used to prevent unauthorized removal of the derail.
Figure 9:
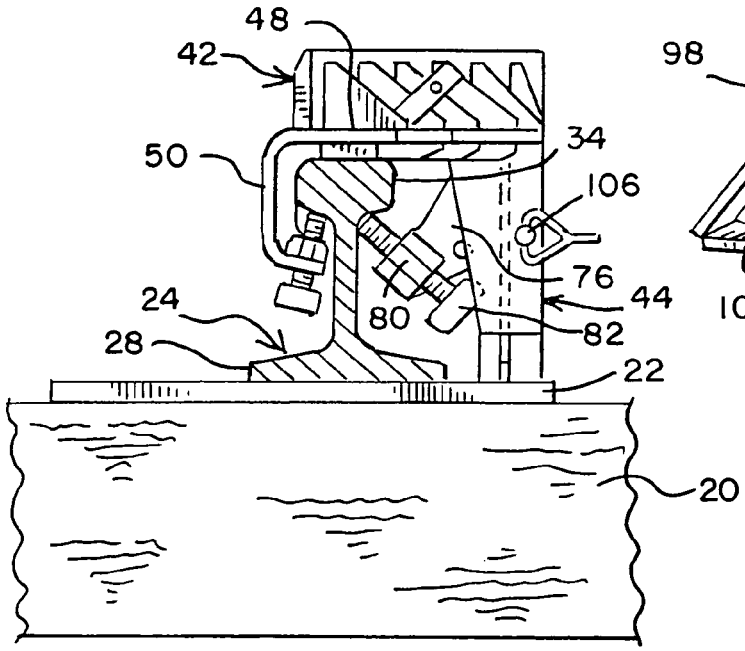
FIG. 9 is an end view of the derail of FIG. 1, but showing a holding pin in position to hold the swing arm in a locked position.
Figure 10:
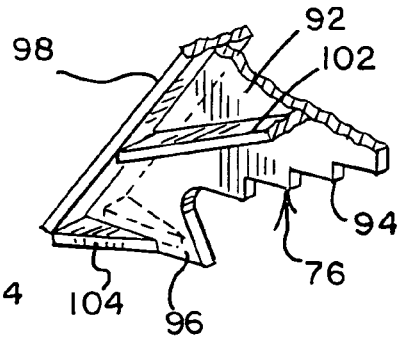
FIG. 10 is a perspective view of the elongated tooth-like projection on the comb of the derail.

The securing assembly 44, as may be seen in FIGS. 8 and 9, includes a locking pad 74. The locking pad is welded to the underside of plate 48 and is perpendicular to the plate. A swing arm 76 is mounted on a pivot 78 to rotate about the pivot from an open position, as shown in FIG. 3, to a locked position, as shown in FIG. 4. The swing arm has an enlarged threaded body 80 which has a retainer thumbscrew 82 mounted therein. The swing arm has a pair of apertures 84 and 86. The locking pad has a locking aperture 88 therein. The securing assembly is shown in FIGS. 8 and 9 in a locked attitude wherein a pad lock 90 is mounted in aperture 88 of the locking pad and aperture 86 of the swing arm to lock the swing arm in an attitude positioning retainer thumbscrew 82 adjacent to the rail. Positioning of aperture 84 aligned with locking aperture 88 and securing the swing arm in that position allows the derail to be removed from the rail head. Thus, the securing assembly provides selective positions of the swing arm either to secure the derail to the rail head or allow the derail to be moved or removed as needed.

Comb assembly or restrainer 46 includes a flat base 92 having a plurality of saw teeth 94 on one edge. An elongated tooth-like projection 96 aligned with saw teeth 94 is formed integral with base 92 for engagement with a railroad tie to restrain movement of the derail along the rail. The comb assembly includes a plurality of reinforcing stripes. An elongated back strip 98 is secured to one edge of the base. A forward reinforcing strip 100 is fixed to base 92. A saw tooth brace 102 is fixed to the base adjacent to saw teeth 94. A tooth plate 104 is fixed to the base adjacent to projection 96 to reinforce projection 96.

Derail 26 may be readily installed on rail 24 by a single workman. The derail is lightweight, in that, it weighs 36 pounds, so that it may be handled by a single workman. Comb assembly 46 is inserted into ballast adjacent to the gauge side of the rail with the channel aligned with the rail head. The channel of the derail is placed over the field side of the rail and thumbscrews 56, 58, and 60 are tightened to secure the body of the derail to the rail. The swing arm is swung on the locking pad from an open position as shown in FIG. 3 to the locked position shown in FIGS. 4, 8, and 9. Although FIG. 8 shows a pad lock holding the swing arm in position, it may be held in position by a pin 106, as shown in FIG. 9. Fastener 82 is threaded into body 80 and is tightened so that the fastener engages the underside of the rail head, as shown in FIGS. 4, 8, and 9. With the derail in position and tightened, the distance from a plane parallel to the top of the rub bar to the top of the rail head is 2¾ inches or less so that the derail has a low profile and any track clearing equipment on a locomotive does not engage the derail. An edge 106 of the channel is parallel to the rail as is the channel. The distance from the upper side of the rider plate to the top of rail head is ¾ inch to give a short climb for a wheel which engages the derail.

Once the derail is in position, it is operative to prevent railway equipment from moving along the rail past the derail. The derail, in position, receives the flanged wheel of a railway equipment not shown, so that the wheel rides up beveled plate 64. Even though the wheel has a short climb, the wheel applies a force to the derail in a direction along the length of the rail. Should the derail move along the rail head, saw teeth 54 engages the tie plate and the tie to restrict movement of the derail. In the event that the saw teeth do not prevent the derail from moving along the rail, tooth-like projection 96 engages the tie and prevents further movement. The distance of movement is small and no greater than the distance from the tooth-like projection to the tie in the initial engagement of the wheel with the derail. The wheel then travels over the bevel plate onto rider plate 48 and engages the rub bar. Engagement of the wheel with the rub bar creates a force on the rub bar to move the plate toward the gauge side of the rail. The movement is prevented by the cooperation of the thumbscrews 56, 58, and 60 on the channel with the field side of the rail. The continued movement of the wheel in engagement with the rub bar causes a smooth steady sideways movement of the wheel which causes the other wheel of the pair of well known railroad wheels (not shown herein) to slide off on the gauge side of the rail of the other rail of the pair of rails which make up a well known railroad track. Substantially simultaneously, the wheel in engagement with the rub bar falls off its rail to effect a derailment.

It may be appreciated that derail 26 may be readily removed from the rail. The pad lock or pin is removed from the swing arm and thumbscrews 56, 58, and 60 are loosened so that the derail can be lifted from the rail for transportation to another location or storage. All of which may be effected by a single workman.

The construction of the present derail optimizes the strengths of all of the parts with a minimum of bulk which thereby reduces the weight of the derail to a weight which is manageable by a single workman.

Although a specific embodiment of the herein disclosed invention has been shown in the accompanying drawings and described above, it is readily apparent that those skilled in the art will be able to make modifications and changes in the derail without departing from the spirit and scope of the present invention. The present invention is limited only by the scope afforded by the accompanying claims.

What is claimed is:

1. A portable low profile derail releasably securable to a railroad rail including a rail head having a field side and a gauge side for derailing from the rail head a flanged wheel of railroad equipment including:

a monolithic derail body having a flat rider plate and an integral elongated holding channel formed integral with an edge of the rider plate, said rider plate having an upper side and an opposed underside, said holding channel adapted to receive a portion of the field side of the rail head, said holding channel being substantially parallel to the rail head when the derail is mounted on the rail head, at least three field side fasteners mounted on the holding channel and connectable with an underside of the field side of the rail head, a substantially straight rub bar fixed to the upper side of the rider plate, said rub bar having a straight top edge, said rub bar having an end adjacent to the holding channel defining a bar angle with said channel edge, and a securing assembly fixed to the underside of the rider plate and being selectively connectable with an underside of the gauge side of the rail head for selectively securing the derail onto the rail head.

2. A low profile portable derail releasably securable to a railroad rail including a rail head having a field side and a gauge side for derailing from the rail head a flanged wheel of railroad equipment as defined in claim 1;

wherein the bar angle between the rub bar and the channel is approximately 18.63°, and the derail has a weight of 36 pounds or less.

3. A low profile portable derail releasably securable to a railroad rail including a rail head having a field side and a gauge side for derailing from the rail head a flanged wheel of railroad equipment as defined in claim 1, including;

a plurality of gussets fixed to the upper side of the rider plate and to the rub bar, wherein the distance from the upper side of the rider plate to the rail head is ¾ inch or less when the derail is operationally installed on the railroad rail.

4. A low profile portable derail releasably securable to a railroad rail including a rail head having a field side and a gauge side for derailing from the rail head a flanged wheel of railroad equipment as defined in claim 1, wherein;

said rub bar having a top edge defining a top edge plane spaced away from the upper side of the rider plate, and the top edge plane is no greater than 2¾ inches from the rail head when the derail is operatively secured to the rail head.

5. A low profile portable derail releasably securable to a railroad rail including a rail head having a field side and a gauge side for derailing from the rail head a flanged wheel of railroad equipment as defined in claim 1, including;

a rooster comb fixed to the underside of the rider plate and being positionable adjacent to the rail, and an enlarged tooth-like projection on the rooster comb engagable with a railroad tie adjacent to the rail to secure the derail relative to the tie.

6. A low profile portable derail releasably securable to a railroad rail including a rail head having a field side and a gauge side for derailing from the rail head a flanged wheel of railroad equipment as defined in claim 1;

wherein the bar angle between the rub bar and the channel is approximately 18.63°, and each of said field side fasteners being a thumbscrew.

7. A low profile portable derail releasably securable to a railroad rail including a rail head having a field side and a gauge side for derailing from the rail head a flanged wheel of railroad equipment as defined in claim 1, including;

a rooster comb fixed to the underside of the rider plate, and an enlarged tooth-like projection on the rooster comb engageable with a railroad tie adjacent to the rail to secure the derail relative to the tie, wherein each of said field side fasteners being a thumbscrew.

8. A low profile portable derail releasably securable to a railroad rail including a rail head having a field side and a gauge side for derailing from the rail head a flanged wheel of railroad equipment as defined in claim 1, including;

a plurality of gussets fixed to the upper side of the rider plate and to the rub bar, a rooster comb fixed to the underside of the rider plate, said rooster comb having an edge with saw teeth formed therein, and an elongated tooth-like projection aligned with the saw teeth being positionable adjacent to the rail for engagement with a rail supporting apparatus to limit movement of the derail.

9. A low profile portable derail releasably securable to a railroad rail including a rail head having a field side and a gauge side for derailing from the rail head a flanged wheel of railroad equipment as defined in claim 1, wherein the weight of the derail is 36 pounds or less;

each of said field side fasteners being a thumbscrew.

10. A low profile portable derail releasably securable to a railroad rail including a rail head having a field side and a gauge side for derailing from the rail head a flanged wheel of railroad equipment as defined in claim 1, including;

wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head.

11. A low profile portable derail releasably securable to a railroad rail including a rail head having a field side and a gauge side for derailing from the rail head a flanged wheel of railroad equipment as defined in claim 1, including;

wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, wherein the distance from the upper side of the rider plate to the rail head is ¾ inch or less when the derail is operationally installed on the railroad rail.

12. A low profile portable derail releasably securable to a railroad rail including a rail head having a field side and a gauge side for derailing from the rail head a flanged wheel of railroad equipment as defined in claim 1, including;

wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, said retainer fastener and each of the field side fasteners being a thumbscrew.

13. A low profile portable derail releasably securable to a railroad rail including a rail head having a field side and a gauge side for derailing from the rail head a flanged wheel of railroad equipment as defined in claim 1, including;

a rooster comb fixed to the underside of the rider plate, said rooster comb being saw teeth on one edge and an elongated tooth-like projection aligned with the saw teeth and being positionable adjacent to the rail for engagement with a rail supporting apparatus to limit movement of the derail, wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, said rub bar having an edge defining a top edge plane spaced away from the upper side of the rider plate, and the top edge plane is no greater than 2¾ inches from the rail head when the derail is operatively secured to the rail head.

14. A low profile portable derail releasably securable to a railroad rail including a rail head having a field side and a gauge side for derailing from the rail head a flanged wheel of railroad equipment as defined in claim 1, including;

wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, wherein the distance from the upper side of the rider plate to the rail head is ¾ inch or less when the derail is operationally installed on the railroad head, said rub bar having an edge defining a top edge plane spaced away from the upper side of the rider plate, and the top edge plane is no greater than 2¾ inches from the rail head when the derail is operatively secured to the rail head.

15. A low profile portable derail releasably securable to a railroad rail including a rail head having a field side and a gauge side for derailing from the rail head a flanged wheel of railroad equipment as defined in claim 1, including;

a rooster comb fixed to the underside of the rider plate, said rooster comb being saw teeth on one edge and an elongated tooth-like projection aligned with the saw teeth and being positionable adjacent to the rail for engagement with a rail supporting apparatus to limit movement of the derail, wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, said rub bar having an edge defining a top edge plane spaced away from the upper side of the rider plate, the top edge plane is no greater than 2¾ inches from the rail head when the derail is operatively secured to the rail head, and said retainer fastener and each of the field side fasteners being a thumbscrew.

16. A low profile portable derail releasably securable to a railroad rail including a rail head having a field side and a gauge side for derailing from the rail head a flanged wheel of railroad equipment as defined in claim 1, including;

a rooster comb fixed to the underside of the rider plate, said rooster comb being saw teeth on one edge and an elongated tooth-like projection aligned with the saw teeth and being positionable adjacent to the rail for engagement with a rail supporting apparatus to limit movement of the derail, wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, said rub bar having an edge defining a top edge plane spaced away from the upper side of the rider plate, and the top edge plane is no greater than 2¾ inches from the rail head when the derail is operatively secured to the rail head, and wherein the bar angle between the rub bar and the channel is approximately 18.63°.

17. A low profile portable derail releasably securable to a railroad rail including a rail head having a field side and a gauge side for derailing from the rail head a flanged wheel of railroad equipment as defined in claim 1, including;

a rooster comb fixed to the underside of the rider plate, said rooster comb being saw teeth on one edge and an elongated tooth-like projection aligned with the saw teeth and being positionable adjacent to the rail for engagement with a rail supporting apparatus to limit movement of the derail, wherein the securing assembly includes a locking pad fixed to the underside of the rider plate, said locking pad having a locking aperture, a swing arm pivotal relative to the locking pad, a retainer fastener threadedly mounted on the swing arm, said swing arm having a pair of positioning apertures spaced apart from each other, one of said positioning apertures being positionable adjacent to the locking aperture of the locking pad to hold the swing arm in a retracted position to allow the derail to be moved relative to the head, and the other of said spaced positioning apertures being positionable adjacent to the locking aperture to hold the swing arm in a position with the retainer fastener in connection with the underside of the head to secure the derail to the head, said derail having a weight of 36 pounds or less, said rub bar having an edge defining a top edge plane spaced away from the upper side of the rider plate, the top edge plane is no greater than 2¾ inches from the rail head when the derail is operatively secured to the rail head, and wherein the bar angle between the rub bar and the channel is approximately 18.63°.

* * * * *